US008845146B2

(12) United States Patent
Blankestijn et al.

(10) Patent No.: US 8,845,146 B2
(45) Date of Patent: Sep. 30, 2014

(54) CONNECTOR FOR CONNECTING A COMPONENT TO A HEAT SINK

(75) Inventors: Jan-Ivo Blankestijn, Best (NL); Peter Hubertus Franciscus Deurenberg, 's Hertogenbosch (NL); Merijn Keser, Eindhoven (NL); Huib Cooijmans, Son en Breugel (NL); Michel Cornelis Josephus Marie Vissenberg, Roermond (NL)

(73) Assignee: Koninklijke Philips N.V., Eindhoven (NL)

( * ) Notice: Subject to any disclaimer, the term of this patent is extended or adjusted under 35 U.S.C. 154(b) by 138 days.

(21) Appl. No.: 13/379,037

(22) PCT Filed: Jun. 11, 2010

(86) PCT No.: PCT/IB2010/052600

§ 371 (c)(1),
(2), (4) Date: Dec. 19, 2011

(87) PCT Pub. No.: WO2010/146509

PCT Pub. Date: Dec. 23, 2010

(65) Prior Publication Data

US 2012/0106177 A1 May 3, 2012

(30) Foreign Application Priority Data

Jun. 17, 2009 (EP) ..... 09162943
Aug. 14, 2009 (EP) ..... 09167919

(51) Int. Cl.

| | |
|---|---|
| ***F21V 29/00*** | (2006.01) |
| ***F21V 19/00*** | (2006.01) |
| ***F21V 19/04*** | (2006.01) |
| ***F21V 17/14*** | (2006.01) |
| *F21Y 101/02* | (2006.01) |
| *F21S 8/02* | (2006.01) |

(52) U.S. Cl.

CPC ..... *F21V 17/14* (2013.01); *F21V 19/001* (2013.01); *F21V 29/2218* (2013.01); *F21V 19/045* (2013.01); *F21V 29/004* (2013.01); *F21Y 2101/02* (2013.01); *F21S 8/026* (2013.01); *F21V 29/225* (2013.01)

USPC ..... 362/373; 362/647; 362/651; 362/294; 362/364

(58) Field of Classification Search

USPC ..... 362/382, 651, 640, 294, 373, 548, 126, 362/165, 657, 274, 365, 147, 646, 647, 649, 362/364, 249.02, 249.05, 547.345; 439/332, 548

See application file for complete search history.

(56) References Cited

U.S. PATENT DOCUMENTS 4,139,957 A * 2/1979 Minogue ..... 40/572
5,989,070 A * 11/1999 Al-Turki ..... 439/644

(Continued)

FOREIGN PATENT DOCUMENTS

WO 2007135579 A1 11/2007

OTHER PUBLICATIONS

WO 2007/135579 A1—International Application Published under PCT.*

(Continued)

*Primary Examiner* — Thomas Sember
(74) *Attorney, Agent, or Firm* — Meenakshy Chakravorty

(57) ABSTRACT

A connector (100) for connecting a component (102) to a heat sink (104), wherein the connector (100) is formed as a female part of a bayonet coupling enclosing an opening (106) for receiving one of the component (102) and the heat sink (104). Further, the connector (100) in use is arranged to ensure direct thermal contact between the component (102) and the heat sink (104) in the opening (106).

15 Claims, 7 Drawing Sheets

(56) References Cited

U.S. PATENT DOCUMENTS

| | | | | |
|---|---|---|---|---|
| 6,502,962 | B1 * | 1/2003 | Menke et al. | 362/294 |
| 7,144,355 | B2 * | 12/2006 | Momochi et al. | 483/31 |
| 7,455,430 | B2 * | 11/2008 | Huang | 362/294 |
| 7,488,097 | B2 * | 2/2009 | Reisenauer et al. | 362/373 |
| 7,621,667 | B2 * | 11/2009 | Behr et al. | 362/651 |
| 7,806,575 | B2 * | 10/2010 | Willwohl et al. | 362/547 |
| 7,976,335 | B2 * | 7/2011 | Weber et al. | 439/487 |
| 8,485,713 | B2 * | 7/2013 | Atalay | 362/651 |
| 2006/0098440 | A1 * | 5/2006 | Allen | 362/294 |
| 2006/0198149 | A1 * | 9/2006 | Jonsson et al. | 362/373 |
| 2009/0116251 | A1 * | 5/2009 | Harbers et al. | 362/373 |

OTHER PUBLICATIONS

WO 2011/145018 A1—International Application Published under PCT.*

WO 2007/135579 A1—International PCT Application Published on Nov. 29, 2007.*

WO 2011/145018 A1—International PCT Application Published on Nov. 24, 2011.*

* cited by examiner

CONNECTOR FOR CONNECTING A COMPONENT TO A HEAT SINK

FIELD OF THE INVENTION

The present invention relates to a connector for connecting a component to a heat sink.

BACKGROUND OF THE INVENTION

In many applications it may desirable to connect a component to a heat sink to provide enhanced heat dissipation. This may be applicable, for example, in general lighting applications that use light emitting diodes (LEDs).

The dominating conception in the market today seems to be that LEDs "last forever", or at least about 50 000 hours, and do not break down prematurely. Thus, most fixture designs are such that if the light source fails, the entire fixture needs to be replaced. However, just as other types of light sources, LEDs may show early failures. In addition, in some applications (e.g. shops, restaurants, bars), the refurbishment cycles are much shorter than the specified LED lifetime of 50 000 hours, whereas in other applications (e.g. outdoor, street, office, and hospital), the LED lifetime is shorter than the refurbishment cycle. Thus, an arrangement that enables easy replacement of the LED module seems desirable.

U.S. Pat. No. 7,549,786 discloses a lamp holder arrangement for facilitating the replacement of an LED that comprises an LED chip mounted on a mounting substrate having electrical contacts. The lamp holder comprises lamp holder power contacts for contacting the electrical contacts on the mounting substrate of the LED lamp and supplying power to the LED chip, and a mechanism for maintaining the lamp holder power contact in electrical contact with the electrical contacts during operation and for allowing the LED lamp to be readily removed and replaced by hand when it is desired to replace the LED lamps.

However, sometimes the properties of the LED module are such that the LED module cannot contain enough heat sinking capabilities to dissipate all generated heat, and it may thus be required to connect the LED module to an external heat sink. Hence, there seem to be a need for a connector for releasably connecting a component, such as a LED module, to a heat sink, which connector provides a more reliable connection in order to ensure proper thermal transfer between the component and the heat sink.

SUMMARY OF THE INVENTION

It is an object of the present invention to provide a connector for releasably connecting a component to a heat sink in a reliable way to ensure efficient heat dissipation.

According to an aspect of the invention, this and other objects are achieved by a connector for connecting a component to a heat sink, wherein the connector is formed as a female part of a bayonet coupling enclosing an opening for receiving one of the component and the heat sink, wherein the connector in use is arranged to ensure direct thermal contact between the component and the heat sink in the opening.

The component may be a lighting module, or another (second) heat sink.

The present invention is based on the understanding that a bayonet coupling with an opening adapted to receive a component (or a heat sink) enables a firm but releasable mechanical connection between the component and a heat sink, while at the same time ensuring a direct thermal contact between a thermal interface of the component and the heat sink.

"Direct" in the present context is intended to indicate that the connector does not extend into the thermal path between the component and the heat sink. The firm and direct contact between the thermal interface of the component and the heat sink promotes thermal transfer, thereby removing the need for thermal paste, and thus facilitating replacement of the component. Another advantage is that "the twist and lock" functionality of the bayonet coupling provides an intuitive way to connect (and disconnect) the component and the heat sink. It also enables single hand replacement operation.

It should be understood that the connector may continuously enclose the opening for receiving one of the component and the heat sink, e.g. if the connector would have the shape of a continuous ring "O", or the connector may discontinuously enclose the opening for receiving one of the component and the heat sink, e.g. if the connector would have the shape of two opposite parenthesis "( )".

The connector may be made of a thermally non-conductive material, such as plastic. Thermally non-conductive here is intended to indicate that that the material has a low thermal conductivity, e.g. a thermal conductivity below 1 (W/m·K) or a thermal conductivity below 0.1 (W/m·K). An advantage associated herewith is that the connector may be produced at a low cost.

Moreover, the connector may be adapted to be fixedly attached to the heat sink. As the component can be connected to the heat sink by means of the connector, this facilitates replacement of the component. For example, if the component is a lighting module it can be easily replaced in the event of failure. The lighting module can also be replaced by another lighting module (e.g. with a different color temperature or beam width). If the component is an additional heat sink, it is possible to easily enhance heat dissipation by connecting the additional heat sink to the heat sink.

Furthermore, the connector may be adapted to be fixedly attached to the component. As the heat sink can be connected to the component by means of the connector, this allows for easy replacement of the heat sink by a larger/smaller heat sink and facilitates adaptation of a luminaire to local application conditions. The thermal dissipation can thus be adapted to, for example, the local temperature (extremely warm/cool ambient temperatures) rooms with low convection or with a lot of ventilation, fixtures connected to insulating ceilings or free-hanging fixtures, etc. Moreover, it enables use of the same luminaire for many applications, without requiring an over-dimensioned bulky heat sink that has to cope with the worst-case scenario.

The connector may be a lamp holder further comprising an electrical interface adapted to supply power to the lighting module. Thus, the lamp holder may provide both an electrical connection to a power supply circuit for supplying power to the lighting module and a mechanical fastening of the lighting module. Furthermore, by providing external electrical contacts on the lighting module (e.g. protruding contact pins) and arranging the electrical contacts inside the lamp holder (e.g. in holes or recesses in the lamp holder) enhanced safety can be achieved for dangerously high voltages (e.g. AC mains). Moreover, the connector may be adapted to define a predetermined pressure between a thermal interface of the component and the heat sink. The predetermined contact pressure may preferably be selected to promote good thermal contact. The pressure may e.g. be in the range 1 to 10 PSI (pound-force per square inch).

The connector may comprise a first annular member arranged to be firmly mounted in relation to the first heat sink (or in relation to the component), and a second annular member resiliently supported in relation to the first annular member. The second annular member may preferably be supported by at least one resilient element, such as a set of springs. However, other types of resilient elements may also be used, such as an element (e.g. a cylinder) made of silicone rubber or other suitable elastic material. The at least one resilient element may be configured to achieve an adequate pressure between the component and the first heat sink to promote good thermal transfer.

According to another aspect of the invention, there is provided a lighting module comprising a plug for connection with a connector, wherein the connector is formed as a female part of a bayonet coupling enclosing an opening. The plug is formed as a male part of a bayonet coupling and is adapted to be received in the opening provided in the connector, wherein the plug includes a thermal interface arranged such that, when the lighting module is connected to the connector, the thermal interface is located in the opening, to enable direct thermal contact with a heat sink attached to the connector.

Further, the plug of the lighting module may comprises a structure (e.g. a set of protrusions or recesses) for mechanically connecting the lighting module to the receiving part of the bayonet coupling, wherein the thermal interface may be resiliently supported in relation to the structure. This can be achieved by means of at least one resilient element such as spring or an element made of silicone rubber or other suitable elastic material. Thus, a predetermined pressure can be achieved between the lighting module and the heat sink to promote thermal transfer.

The thermal interface may comprise a layer which is compressible, This allows the thermal interface to shape around surface irregularities (such as particle contamination) on the heat sink, and provides an interface which is more robust against scratches and dust. An example of such a layer is a metal film with silicon adhesion (e.g. Laird T-Flex 320H)

Furthermore, the thermal interface may comprise a layer configured to promote lubrication, thereby facilitating a twist movement when the thermal interface of the lighting module is in contact with the heat sink. This can be achieved, for example, by means of a graphite foil (e.g. GrafTech HI-710) or a metal film with silicon adhesion (e.g. Laird T-Flex 320H). The metal film with silicon adhesion may be preferred since it is more robust against scratches and irregularities.

According to another aspect of the invention, there is provided a heat sink comprising a plug for connection with a connector, wherein the connector is formed as a female part of a bayonet coupling enclosing an opening. The plug is formed as a male part of a bayonet coupling and is adapted to be received in the opening provided in the connector, wherein the plug includes a thermal interface arranged such that, when the heat sink is connected to the connector, the thermal interface is located in the opening, to enable direct thermal contact with a thermal interface of a lighting module attached to the connector.

Furthermore, the connector according to the present invention may advantageously be included in a lighting fixture for use with a lighting module, wherein the lighting fixture further comprises a heat sink for dissipating heat generated by the lighting module, wherein the connector may be fixedly attached to the heat sink and enables the lighting module to be connected to the heat sink.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION OF THE EMBODIMENTS

Figure 1:
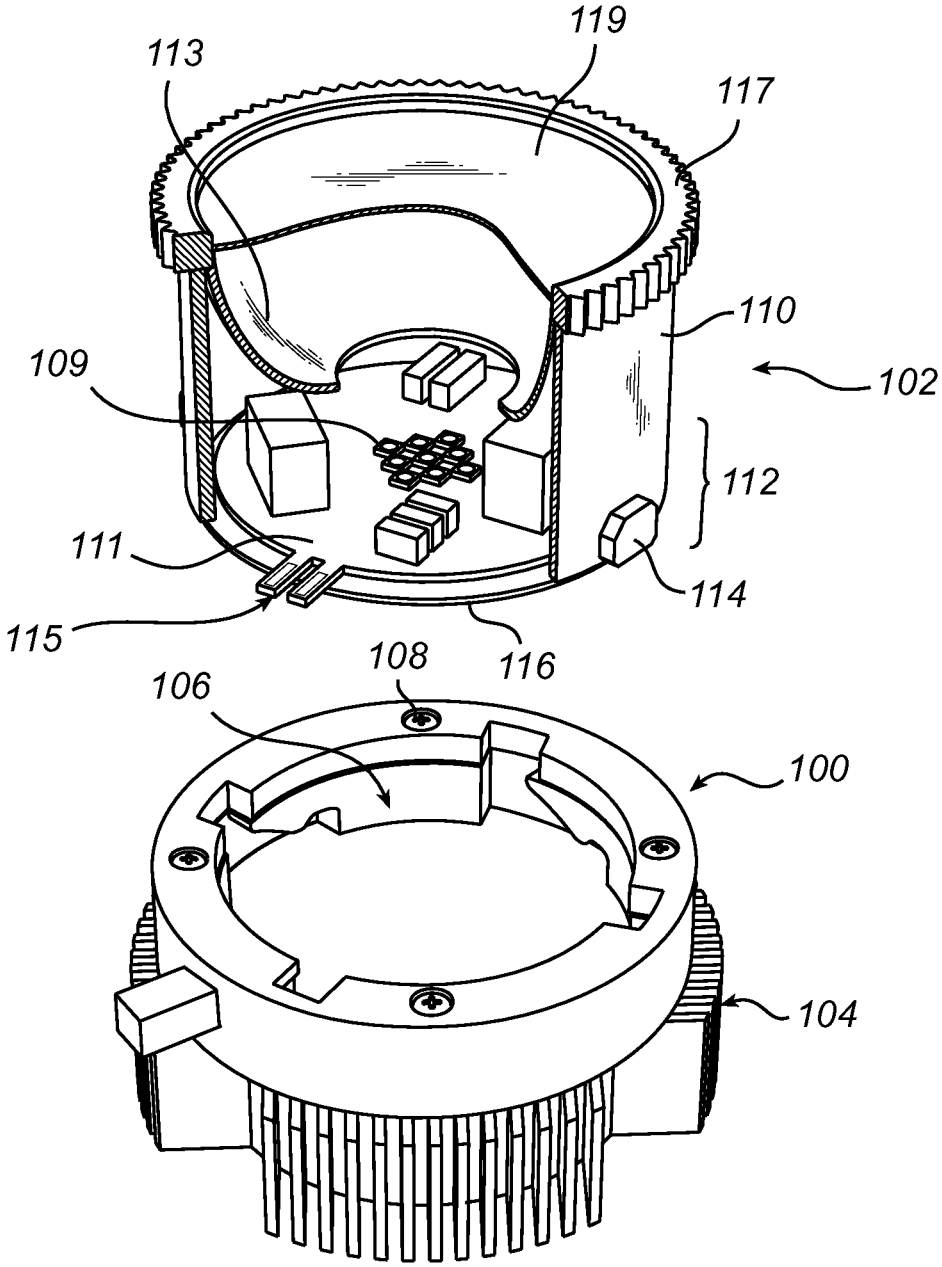
FIG. 1 schematically illustrates a lighting module and a connector according to an embodiment of the invention.

FIG. 1 schematically illustrates a connector 100 for connecting a lighting module 102 to a heat sink 104. The connector (here referred to as a lamp holder 100) is formed as a receiving part of a bayonet coupling enclosing a circular opening 106 for receiving the lighting module 102. The lamp holder 100 is here mounted to the heat sink 104 by screws 108. Thus, as the lighting module 102 is connected to the lamp holder 100, a thermal interface 116 of the lighting module (provided at the bottom of the lighting module) is in direct contact with the heat sink 104, thereby enabling heat dissipation from the lighting module 102 to the heat sink 104.

The lighting module 102 (here referred to as an LED module 102) comprises a cylindrical housing comprising a bottom surface 116, a side wall 110, and a top surface 119. The top surface is here a phosphor disc 119 for allowing light from the LED module to escape. The housing contains a plurality light emitting devices 109, here being light emitting diodes (LEDs) 109 arranged on a printed circuit board 111. The number and type of LEDs may vary depending on the application, but is here nine high power LEDs, each having a power of about 1 W. The LED module 102 may also include a cavity 113 for beam shaping, and a grip ring 117 which a user may grab when the LED module is connected/disconnected to the lamp holder100. Further, a bottom portion 112 of the LED module 102 forms a cylindrical plug 112 (here referred to as lamp cap) adapted to be received by the lamp holder 100. A set of external radial protrusions 114 arranged on the side wall 110 forms fastening pins 114 for mechanically connecting the LED module 102 to the lamp holder 100. Here, there are three fastening pins, but the number of fastening pins may vary. The fastening pins may also be used to create a specific key enabling a fool proof user interface as the specific key only allows the LED module 102 to be inserted in the lamp holder 100 in a single way. This may prevent the wrong electrical polarity and failure of the LED module and is especially applicable for DC connection, AC with earth/ground connection and connection with communication buses such as e.g. DALI/DMX.

The lamp cap 112 is also provided with an electrical interface 115 that enables the LED module 102 to be electrically connected to an external power supply (AC or DC). The electrical interface is here in the form of two electrical contacts 115. The electrical contacts 115, which are here arranged next to each other, extends radially from the housing 110. Arranging the electrical contacts 115 next to each other (rather than on opposite sides of the housing) saves space on the printed circuit board, and reduces electromagnetic interference (EMI). As illustrated in FIG. 1, the electrical contacts 115 may preferably be made directly onto the printed circuit board 111, thereby avoiding further components and costs.

The lamp cap 112 is provided with a thermal interface 116 for thermally connecting the LED module to the heat sink 104. The thermal interface 116 of the LED module is here a flat copper plate arranged to form the bottom of the LED module 102. Other materials having a high thermal conductivity such as carbon, an aluminum alloy, thermally conductive plastic or ceramics may also be used for the thermal interface 116. The flat copper plate 116 is in thermal contact with the LEDs 109, e.g. by means of a series of thermal vias provided in the printed circuit board 111. The area of the thermal interface 116 is designed to enable sufficient heat to be dissipated from the LED module 102 to the heat sink 104. In the illustrated example, the thermal interface 116 constitutes essentially the entire bottom surface of the LED module 102.

Figure 2:
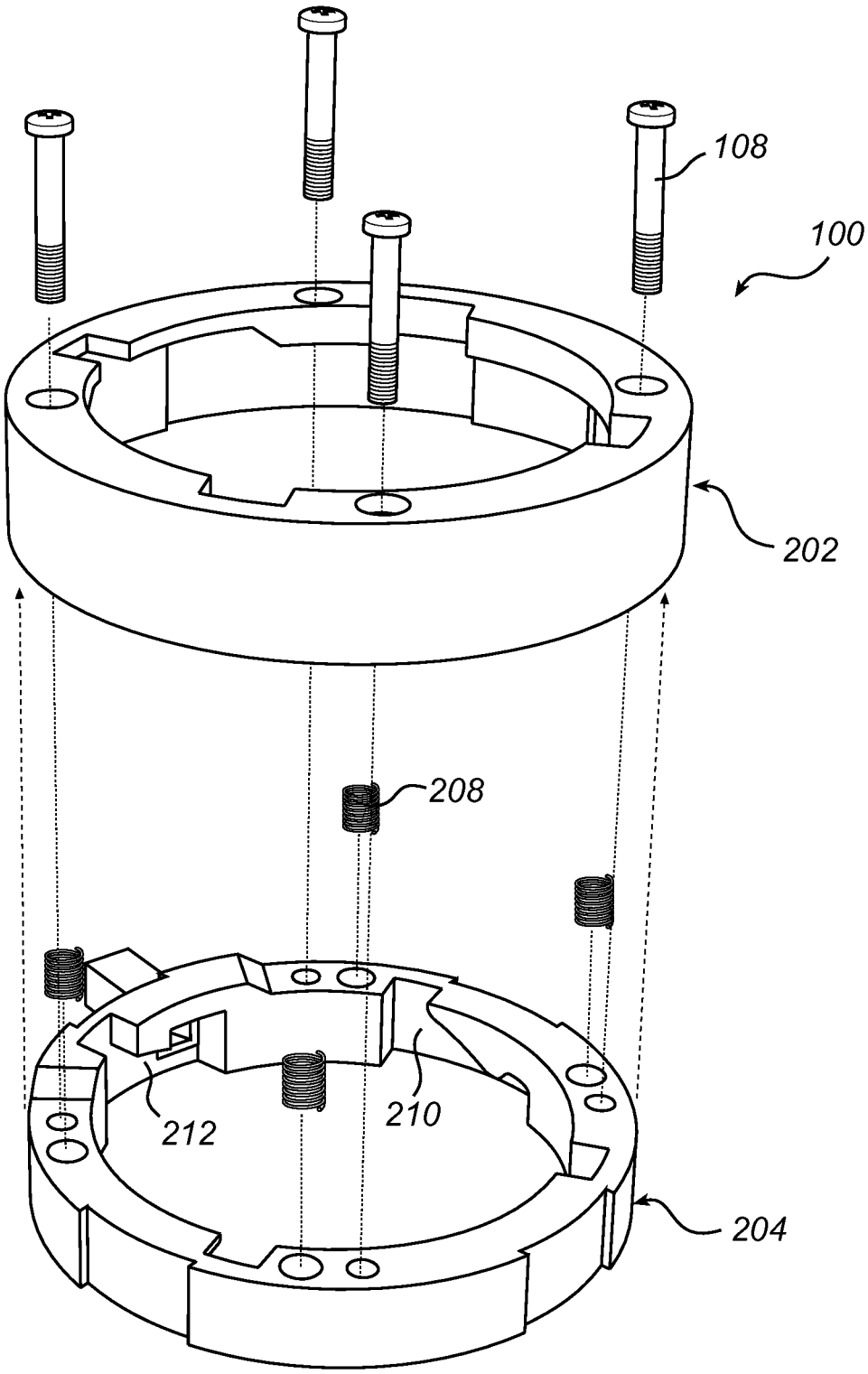
FIG. 2 schematically illustrates a lamp holder according to an embodiment of the invention.

FIG. 2 schematically illustrates a more detailed view of the lamp holder 100 in FIG. 1. The lamp holder 100 comprises a first annular member 202 and a second annular member 204, both of which can be made of thermally non-conductive material such as plastic. The first annular member 202 is firmly mounted to the heat sink 104 by screws 108, whereas the second annular member 204 is resiliently supported in relation to the first annular member 202. The resilient support is here achieved by a set of springs 208, here being four coil springs, arranged between the first 202 and second 204 annular members. However, the number and type of springs may vary. For example, a leaf spring may be used. Furthermore, the resilient support may also be achieved using other types of elastic elements. For example, instead of using a spring, a cylinder made of silicon rubber may be used.

The second annular member 204, here being a plastic ring, is provided with three L-shaped recesses 210 adapted to receive the fastening pins 114 of the LED module 102. There is also an additional L-shaped recess 212 arranged to receive the electrical contacts 115 of the LED module 102. This latter L-shaped recess 212 is provided with an electrical interface in the form of two contact plates in the L-shaped recess 212. The contact plates can be made in copper, or some other electrically conductive material, and can be electrically connected to a power supply circuitry in a luminaire.

Figure 3A:
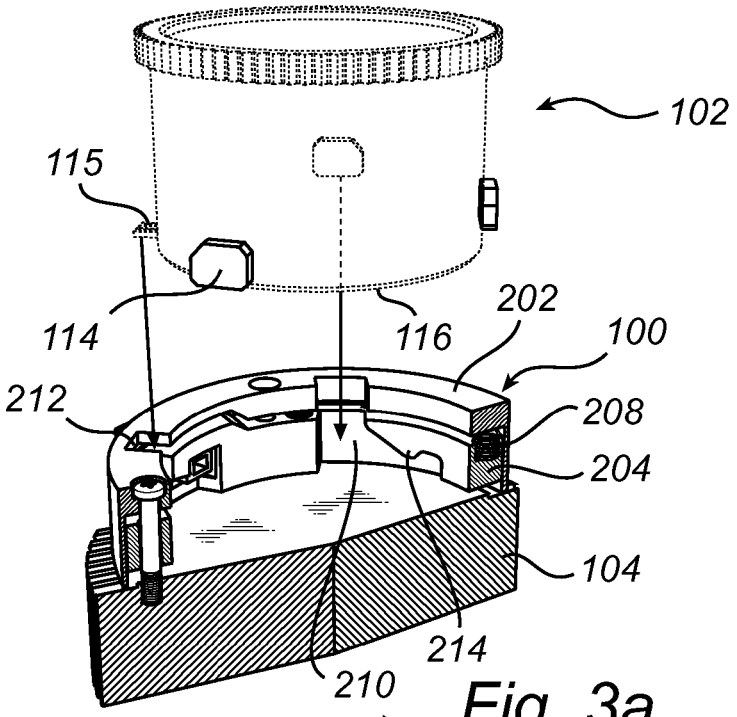
FIGS. 3*a-c* schematically illustrates how a lighting module can be connected to a lamp holder.
Figure 3B:
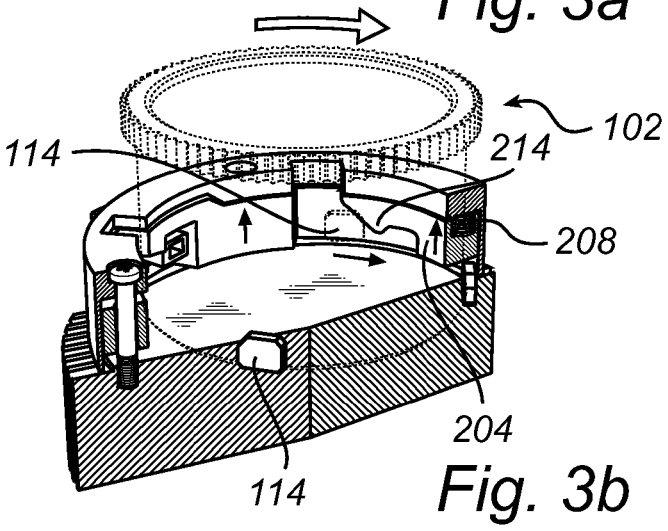
Figure 3C:
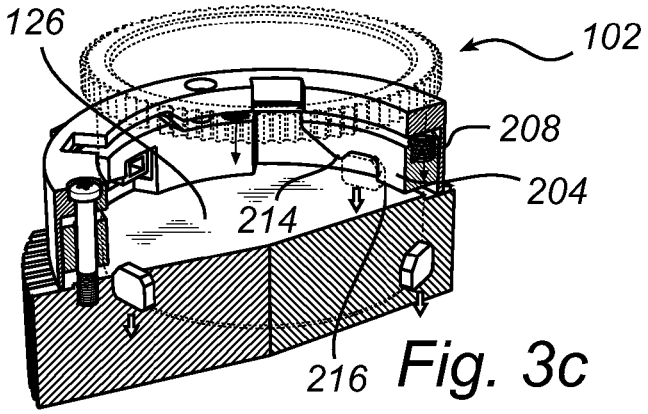

FIG. 3*a-c* schematically illustrates how the LED module 102 is connected to the lamp holder 100. As illustrated in FIG. 3*a*, the fastening pins 114 are introduced into the L-shaped recesses 210, whereas the electrical contacts 115 of the LED module will fit into the L-shaped recess 212. Next, as illustrated in FIG. 3*b*, the LED module 102 is twisted clockwise. As the LED module 102 is twisted, the fastening pins 114 presses the second annular member 204 upwards, compressing the springs 208. As the fastening pins 114 passes the shoulders 214, the user will feel the LED module click into place, and the shoulders 214 will lock the fastening pins 114 in their end positions as illustrated in FIG. 3*c*. (In this position, the electrical contact plates in the lamp holder will be in contact with the electrical contacts 115 of the LED module.) It can be noted that the fastening pins are sufficiently high for the second annular member not to be in contact with the heat sink 104 (as illustrated by gap 216). Thus, the second annular member 204 will press the fastening pins 114 in the direction of the heat sink 104, whereby the thermal interface 116 (i.e. the bottom surface) of the LED module is pressed against the upper surface 126 of the heat sink 104.

The springs 208 may be configured such that a predetermined pressure is applied to the fastening pins 114, whereby a predetermined pressure can also be achieved between the thermal interface 116 of the LED module and the heat sink 104.

It can further be noted that as the opening 106 in the lamp holder 100 is a through-hole, there is a direct contact between the thermal interface 116 of the LED module and the heat sink 104 (i.e. the lamp holder 100 is not in the thermal path).

To facilitate the twist-movement, the thermal interface 116 of the LED module may comprise a layer with a first adhesive side attached to the copper plate of the LED module and a second side (facing the heat sink) that provides ample lubrication for the twist movement. Examples of such a layer are a metal film with silicon adhesion (such as Laird T-Flex 320H) or a graphite foil (such as GrafTech HI-710). Furthermore, by using an interface layer, such as the Laird T-Flex 320H, which is compressible (in thickness), a thermal interface is achieved that is robust against scratches, dust and other particles. According to an alternative embodiment, such a layer may be provided at the heat sink.

Further, to ensure good thermal transfer between the thermal interface 116 of the LED module and the heat sink 104, adequate pressure should preferably be applied. Most thermal interface materials require about 10 PSI (pound-force per square inch) to provide good thermal transfer, but Laird T-Flex 320H can be used with a lower pressure (about 2.5 PSI). A lower pressure may be advantageous because the user needs to generate the torque (when twisting in the module) that creates this pressure. The desired pressure can be achieved, for example, by adjusting the number of springs in the lamp holder and their spring constants.

Figure 4:
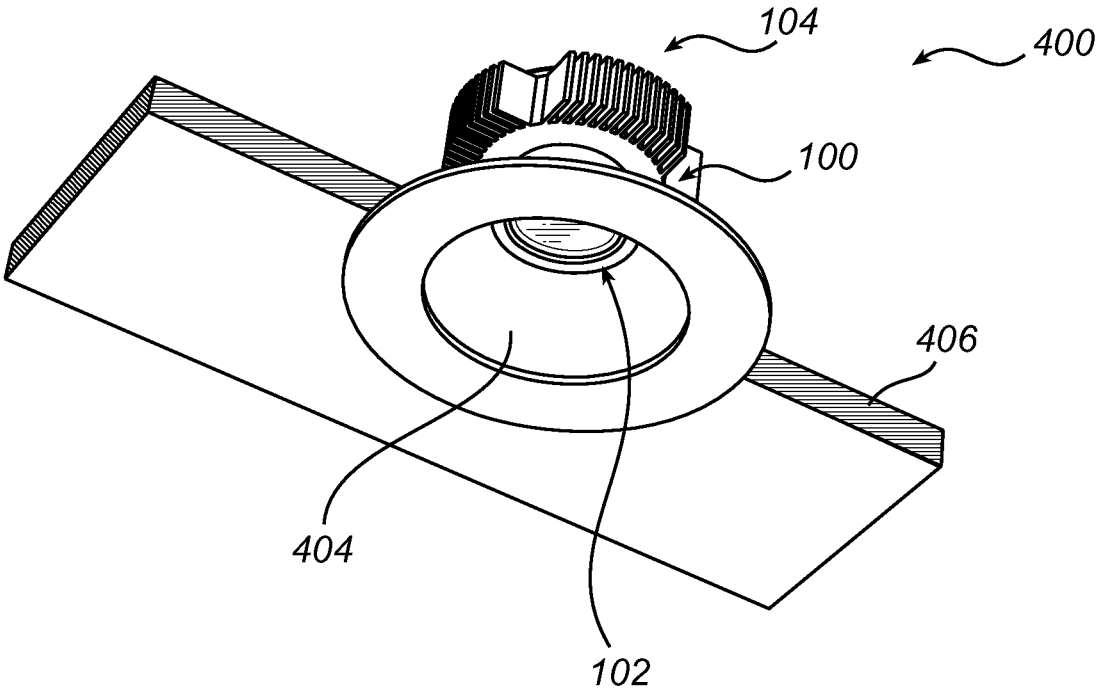
FIG. 4 schematically illustrates a luminaire according to an embodiment of the invention.
Figure 5A:
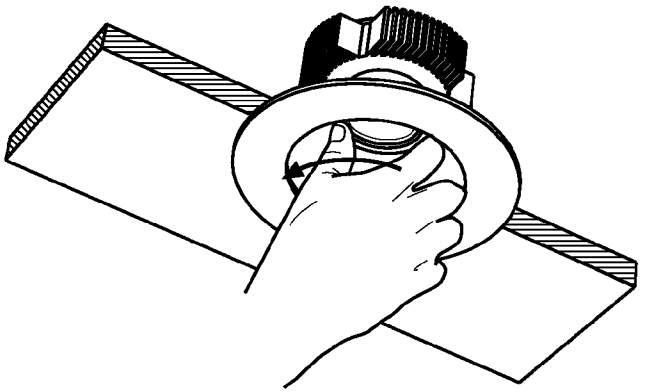
FIGS. 5*a-d* schematically illustrates replacement of a lighting module in a luminaire.
Figure 5B:
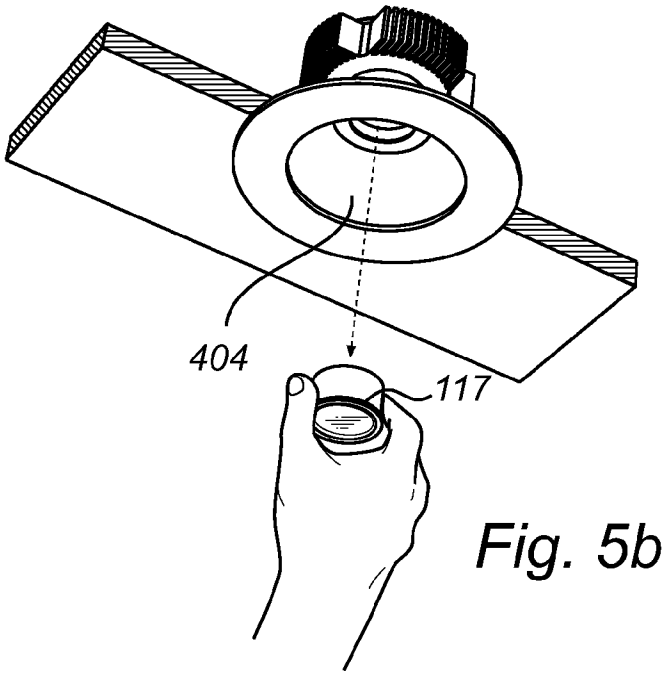
Figure 5C:
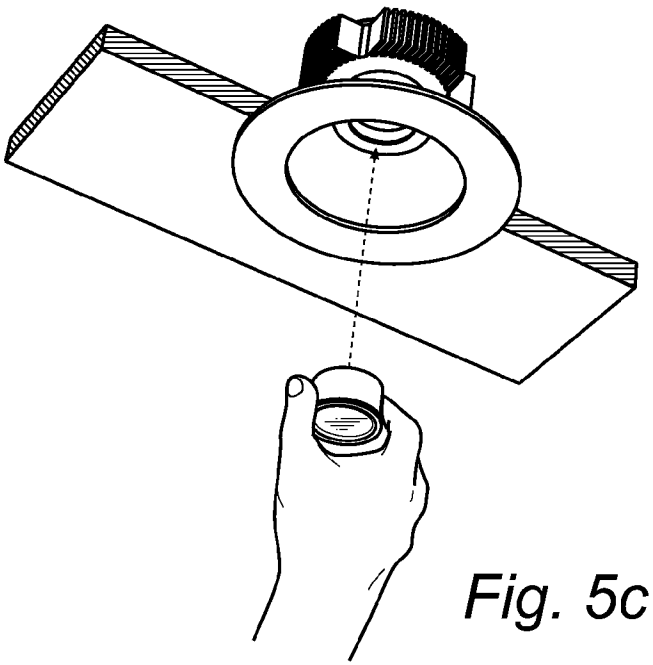
Figure 5D:
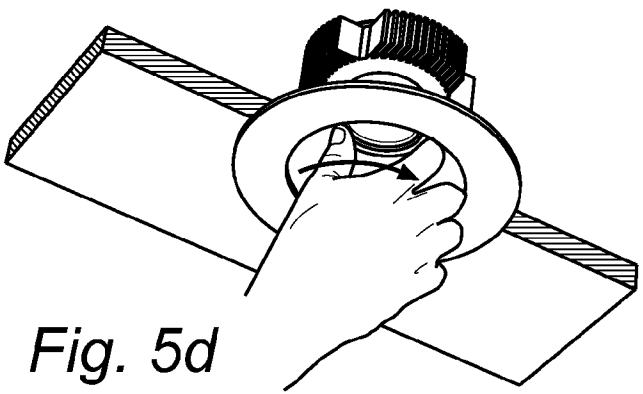

FIG. 4 schematically illustrates a luminaire 400, according to an embodiment of the invention. The luminaire includes a lamp holder 100 and an LED module 102 such as the ones described above in relation to FIG. 1-3.

The lamp holder 100 is here arranged in a lighting fixture mounted in a ceiling 406. The lighting fixture further comprises, a power supply circuit (not shown), a heat sink 104, and a reflector 404. The power supply circuit here includes a voltage converter, and an LED driver.

In operation, the voltage converter converts 230V AC from the mains supply to an LED current. The LED current is then provided to the LEDs 109 in the LED module via the electrical contacts provided in the lamp holder 100. As a result light is emitted by the LEDs 109. At the same time heat is developed at the LED junctions. The heat developed is dissipated from the LED module 102, via the thermal interface 116 of the LED module 102, to the heat sink 104 where the heat is dissipated to the ambient environment. As a precautionary measure, the LED driver may also be equipped with a temperature feedback that ensures that the illumination is either dimmed or switched off when the temperature exceeds a predetermined threshold. This prevents the LED module 102 from overheating if, for some reason, the arrangement fails dissipate sufficient heat.

FIGS. 5*a-d* schematically illustrates how a user may replace the LED module 102 in the luminaire 400. In the illustrated embodiment, the grip ring 117 of the connected LED module 102 protrudes into the fixture reflector 404 to allow for sufficient grip to twist it by hand. Thus, a person may disconnect the LED module 102 from the lighting fixture by grabbing the grip ring 117 of LED module, pressing the lighting module slightly into the lighting fixture (i.e. towards the heat sink), twisting it anti-clockwise, and removing the LED module from the lighting fixture.

The person may then connect a new LED module by grabbing the grip ring 117, introducing the lamp cap 112 of the LED module 102 into the lamp holder 100 arranged in the lighting fixture, pressing the LED module slightly into the lighting fixture (i.e. towards the heat sink 104), and twisting the LED module clockwise until it locks in position. Moreover, as the LED module 102 is connected to the lamp holder100, the lamp holder 100 forces the LED module 102 into a certain position with respect to the lighting fixture and the LED module 102 can therefore be carefully aligned to the fixture reflector 404. According to another embodiment, the fixture reflector 404 can be removed from the lighting fixture to facilitate replacement of the lighting module 102. This also enables higher reflector efficiency because it is no longer required to have a grip ring 117 that protrudes into the fixture reflector 404.

Figure 6A:
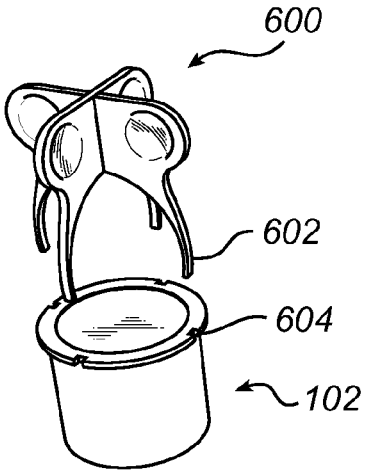
FIGS. 6*a-c* schematically illustrates various embodiments of insertion tools that may be used for connecting/disconnecting a lighting module to a connector.
Figure 6B:
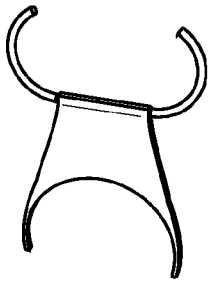
Figure 6C:
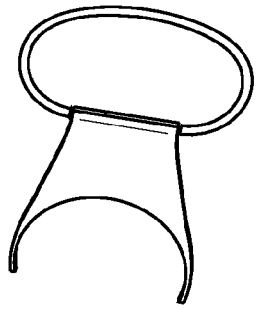

According to yet another embodiment an insertion tool 600 can be used for connecting/disconnecting the LED module 102 to the lighting fixture as schematically illustrated in FIG. 6*a*. By introducing the tips 602 of the insertion tool 600 into a corresponding set of recesses 604 provided in the LED module 102, the LED module 102 can be connect/disconnected from the lighting fixture 402. An advantage by using an insertion tool is that fingerprints on the fixture reflector can be avoided after each replacement cycle. Also the reflector efficiency can be higher because there is no need for a grip ring that protrudes into the fixture reflector. Furthermore, since there is no grip ring, the LED module cannot be removed by hand, requiring either disassembly of the lighting fixture (e.g. removing the fixture reflector) or an insertion tool to remove the LED module. This may reduce the risk of theft of the LED module. The design of the insertion tool may vary as exemplified by the embodiments illustrated in FIGS. 6*a-c*.

Figure 7A:
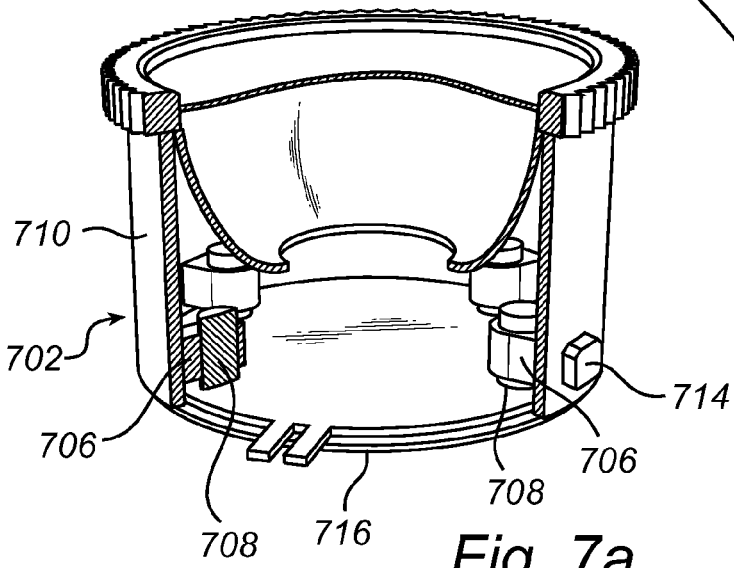
FIGS. 7*a-b* schematically illustrates further embodiments of a lighting module.
Figure 7B:
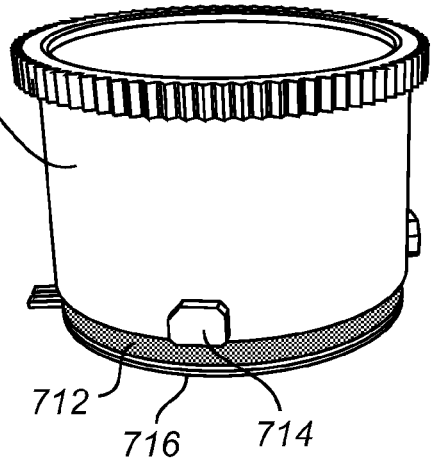

FIGS. 7*a-b* schematically illustrates further embodiments of a lighting module 702. The lighting modules in FIGS. 7*a-b* differ from the lighting module discussed above in that the bottom surface of the lighting module (and thus the thermal interface 716 of the lighting module) is resiliently supported in relation to the fastening pins 714 (and the rest of the housing). As a result, the lighting module in FIG. 7*a-b* may be used with a non-resilient connector (a non-resilient connector can, for example, be achieved by combining the first and second annular members of the lamp holder in FIG. 2 into a single piece).

In FIG. 7*a*, a set of cylindrical rubber elements 708 is firmly mounted to the side wall 710 of the LED module 702 by plastic clamps 706 provided in the side wall 710. The attachment of the rubber elements to the clamps may be reinforced by using an adhesive, such as glue. The rubber elements 708 supports the bottom of the LED module (e.g. the bottom plate may be attached to the rubber elements 708 by an adhesive). Thus, as the lighting module 702 is connected to a receiving part of a bayonet coupling arranged on a heat sink, the bottom surface 716 of the lighting module 702 is pressed (here upwards) into the LED module. As a result, the rubber cylinders are compressed and thereby press the bottom surface 716 of the LED module towards the heat sink.

FIG. 7*b* illustrates an alternative embodiment, where a ring 712 made of rubber silicon is arranged between a bottom end of the side wall 710 of the LED module and a plate that forms the bottom surface 716 of the LED module. Thus, as the lighting module 702 is connected to a receiving part of a bayonet coupling, and the bottom 716 of the LED module is pressed into the LED module, the rubber ring 712 is compressed between bottom end of the side wall 710 and the plate that forms the bottom surface 716 of the LED module. As a result, the rubber ring presses the bottom surface 716 of the LED module towards the heat sink.

Figure 8:
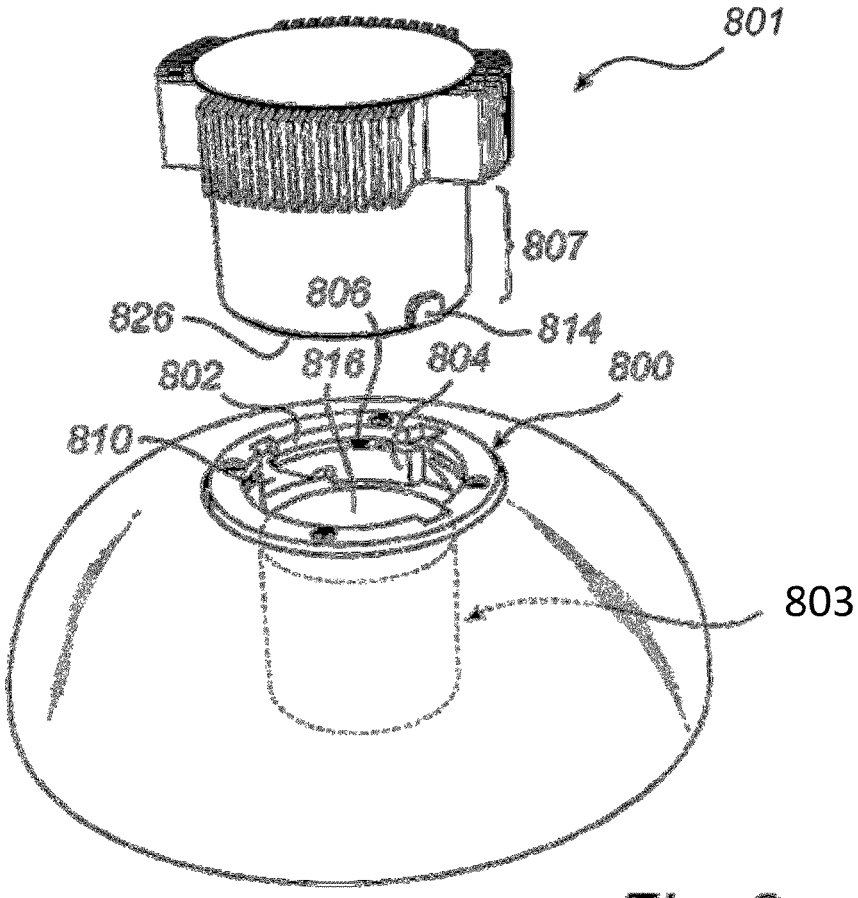
FIG. 8 schematically illustrates an embodiment of a connector for connecting a heat sink to a luminaire.

FIG. 8 schematically illustrates a connector 800 adapted to enable a heat sink 801 to be releasably connected to a luminaire, wherein the luminaire further comprises an LED module 802 with a thermal interface 816 at its bottom surface (i.e. facing the heat sink 801).

The heat sink 801 may typically be made of aluminium and is dimensioned to be able to dissipate the heat generated by the lighting/LED module 803 used in the luminaire. A portion of the heat sink here forms a cylindrical plug 807 (which can also be referred to as a male coupling of a bayonet coupling) provided with a set of radially protruding fastening pins 814 and a thermal interface which is here arranged at the bottom of the heat sink (i.e. at the side facing the thermal interface of the lighting module). The number of fastening pins may vary but is here three.

The connector 800 here comprises a first annular member 802 and a second annular member 804, both of which are made of thermally non-conductive material such as plastic. The first annular member 802 is mounted to the luminaire 800 by screws, whereas the second annular member 804 is resiliently supported in relation to the first annular member 802. The resilient support is here achieved by a set of springs 806 here being four coil springs, but other types of springs may also be used such as a leaf spring. Also, the resilient support may be achieved using other types of elastic elements. For example, instead of using a spring a cylinder made of silicon rubber may be used.

Further, the second annular member 804, here being a plastic ring, is provided with three L-shaped recesses 810 adapted to receive the fastening pins 814 of the heat sink 801. The heat sink can thus be connected to the luminaire, by introducing the fastening pins 814 into the L-shaped recesses 810, and pressing the heat sink 801 into the connector 800 while turning the heat sink clockwise. As the heat sink 801 is connected to the connector 800, the fastening pins 814 will mechanically connect the heat sink 801 to the luminaire, and press the thermal interface 826 of the heat sink against thermal interface 816 of the LED module (similar to what was described for the connector in FIG. 3), thereby enabling efficient heat dissipation from the LED module 803 to the heat sink 801.

Figure 9:
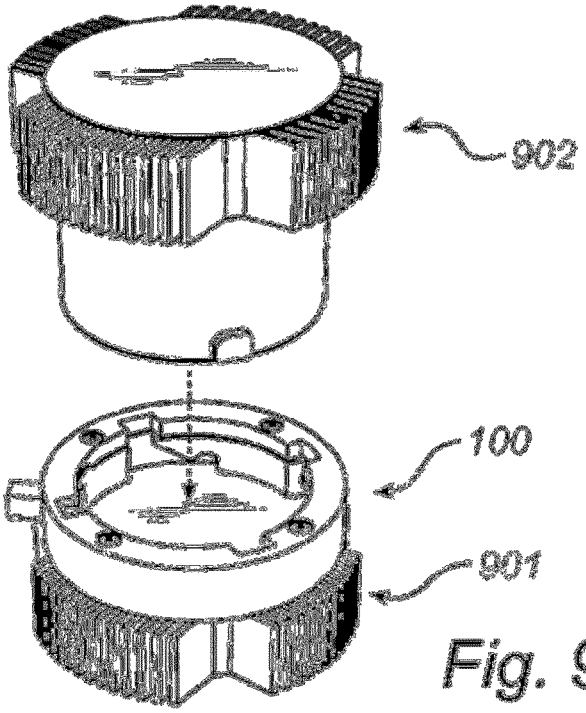
FIG. 9 schematically illustrates an embodiment of a connector for connecting a first heat sink to a second heat sink.

The connector allows for easy replacement of the heat sink by a larger/smaller heat sink. Furthermore, the connector may also be used to connect two heat sinks, thereby enabling easy extension by additional heat sinks. This allows for easy adaptation of a luminaire to local application conditions: the thermal dissipation can thus be adapted to e.g. the local temperature (extremely warm/cool ambient temperatures) rooms with low convection or with a lot of ventilation, fixtures connected to insulating ceiling or free-hanging fixtures, etc). FIG. 9 schematically illustrates an embodiment where a connector 100 attached to a first heat sink 901 is used to connect a second heat sink 902 to the first heat sink 901.

According to yet another embodiment, a luminaire may comprise a first connector for connecting an LED module and a second connector for connecting a heat sink. This allows a flexible application of the luminaire. When a low-power LED module is connected, a small heat sink module can be used, while the same luminaire may also be used with a high-power LED module in combination with a large heat sink module (or multiple heat sink modules). Furthermore, there may be a connector that comprises two female bayonet couplings, wherein each of the female bayonet couplings can receive a male bayonet coupling. This enables both a lighting module and a heatsink to be releasable connected by a single connector.

It can be noted that the connector according to the invention, enables an arrangement that is easily scalable towards power dissipation. By increasing the diameter of the connector/thermal interface/heat sink, a higher power dissipation can be achieved. Furthermore, introducing different diameters for consumer and professional lighting prevents usage of professional modules into consumer applications and can eventually reduce theft of professional modules. Moreover, the height of the LED module is not fixed by the lamp holder and can therefore be adapted towards desired functionality. The additional space can for instance be used to integrate LED driver electronics into the LED module; add beam shaping optics (static or/dynamic); add wireless communication; create a means to connect a reflector; add buttons for configuration (static and/or dynamic); create a means for protection or insertion tools. The size of the LED module can also be reduced by removing electronics to create a LED module that is very flat. This flexibility enables the LED module to be adapted to many different lighting applications. For example, in applications such as track lighting, a low AC or DC voltage may be supplied at the electrical interface between the lamp holder and the LED module by providing a converter for converting the 230V AC to an LED current outside the LED module, thereby enabling a smaller LED module. Further, providing LED driver electronics in the LED module may be advantageous for future readiness and in case electronics fails.

The person skilled in the art realizes that the present invention by no means is limited to the preferred embodiments described above. On the contrary, many modifications and variations are possible within the scope of the appended claims. For example, other solid state light sources than LEDs may be used such as lasers. Further, the lamp holder may be used for any electrical interface, being an AC mains voltage, a low voltage AC voltage or a DC voltage. Also, the electrical contacts may be provided in the fastening pins. However, using separate pins for electrical and mechanical connection may be preferred as it may reduce stress on the printed circuit board. Furthermore, although the male bayonet coupling has here been illustrated as plugs provided with a set of protrusions that forms fastening pins, one may also use a male bayonet coupling provided with a set of recesses (assuming that the female bayonet, i.e. the connector, is provided with a corresponding set of protrusions).

The invention claimed is:

1. A connector for connecting a lighting module to a heat sink, said connector comprising a female part of a bayonet coupling enclosing an opening for receiving one of the lighting module and the heat sink, wherein said connector in use is arranged substantially between the heat sink and the lighting module to ensure direct thermal contact between said lighting module and said heat sink in said opening:

the lighting module including a plug for facilitating connection with a connector, wherein said plug is formed as a male part of a bayonet coupling and is adapted to be received in the opening provided in the connector, wherein said plug includes a thermal interface arranged such that, when said lighting module is connected to said connector, the thermal interface is located in said opening, to enable direct thermal contact with a heat sink attached to the connector.

2. A connector according to claim 1, wherein said connector comprises a thermally non-conductive material.

3. A connector according to claim 1, wherein said connector is adapted to be fixedly attached to said heat sink.

4. A connector according to claim 1, wherein said connector is adapted to be fixedly attached to said lighting module.

5. A connector according to claim 1, wherein said connector is a lamp holder further comprising an electrical interface adapted to supply power to said lighting module.

6. A connector according to claim 1, wherein said connector is adapted to define a predetermined pressure between a thermal interface of said lighting module and said heat sink.

7. A connector according to claim 1, comprising a first annular member arranged to be firmly mounted in relation to said heat sink, and a second annular member resiliently supported in relation to said first annular member.

8. A lighting module comprising a plug for facilitating connection with a connector of claim 1, wherein said plug further has an outwardly extending electrical contact rotationally received in an electrical contact receiving recess of the connector.

9. A lighting module according to claim 8, wherein said plug further comprises a structure for mechanically connecting the lighting module to the receiving part of the bayonet coupling, wherein said thermal interface is resiliently supported in relation to said structure.

10. A lighting module according to claim 8, wherein said thermal interface comprises a layer which is compressible.

11. A lighting module according claim 8, wherein said thermal interface comprises a layer configured to promote lubrication.

12. A lighting module and connector to connect the lighting module to a heat sink, comprising:

a connector interposed between a heat sink and a lighting module, the connector including a central opening and a plurality of bayonet openings along a periphery of the central opening, the central opening of the connector receiving the lighting module, the lighting module further having a thermal interface along a lower surface;

the bayonet openings of the connector receiving a plurality of structures on the lighting module to mechanically connect the lighting module to the connector and maintain the thermal interface in direct thermal contact with the heat sink;

the lighting module further having an electrical contact received within an electrical connector recess of the connector;

wherein the electrical contact and the structures of the lighting module are rotationally received within connector.

13. A connector for a lighting module to maintain the lighting module in thermal contact with a heat sink, comprising:

an aperture within the connector to receive the lighting module, the connector having a plurality of recesses along an inner peripheral wall to rotationally receive a plurality of structures extending outwardly from the lighting module;

the lighting module further having an outwardly extending electrical contact which is rotationally received within an electrical recess of the connector;

the connector substantially interposed between the lighting module and the heat sink;

the lighting module having a thermal interface, the lighting module having a plurality of LEDs along the and a printed circuit board with the LEDs in thermal contact with the thermal interface;

wherein the thermal interface is positioned adjacent the heath sink when the electrical contact and the structures of the lighting module are rotationally received within the connector.

14. The connector for a lighting module to maintain the lighting module in thermal contact with a heat sink of claim 13 further including a layer in the thermal interface which is compressible.

15. The connector for a lighting module to maintain the lighting module in thermal contact with a heat sink of claim 14 further including a layer in the thermal interface which promotes lubrication.

* * * * *